United States Patent [19]

Hutchins

[11] 4,091,544

[45] May 30, 1978

[54] DRYING PROCESS

[75] Inventor: James Peyton Hutchins, Springfield Township, Hamilton County, Ohio

[73] Assignee: The Procter & Gamble Company, Cincinnati, Ohio

[21] Appl. No.: 768,013

[22] Filed: Feb. 11, 1977

[51] Int. Cl.[2] ..... F26B 5/00

[52] U.S. Cl. ..... 34/9; 34/12

[58] Field of Search ..... 34/9, 12, 95

[56] References Cited

U.S. PATENT DOCUMENTS

| | | | |
|---|---|---|---|
| 2,825,655 | 4/1958 | Meadows | 106/164 |
| 2,882,609 | 4/1959 | Templeton | 34/9 |
| 3,137,630 | 6/1964 | Hecker et al. | 167/81 |
| 3,770,816 | 11/1973 | Nielsen | 252/186 X |
| 3,923,944 | 12/1975 | Clark | 264/109 |
| 3,963,118 | 6/1976 | Ferguson | 206/84 |

*Primary Examiner*—John J. Camby

*Attorney, Agent, or Firm*—Douglas C. Mohl; Ronald L. Hemingway; Richard C. Witte

[57] ABSTRACT

A process for drying a water-wet mixture of materials, at least one of which is hydratable, which allows the mixture to be easily formed into the desired size and shape and easily and safely dried.

7 Claims, No Drawings

DRYING PROCESS

BACKGROUND OF THE INVENTION

The present invention is related to a process for drying a water-wet mixture of materials, at least one of which is hydratable. The process involves allowing the mixture to be formed into spherical particles, flakes, ribbons or other desired configuration. The chosen forms are then cooled to a temperature sufficiently low so that the hydratable material is hydrated. To remove the unwanted waters of hydration and free water the material is heated to a temperature which allows the water to be driven off but will not cause the forms to soften and stick together. This process allows for the elimination of the need for further size reduction and the associated dust.

Dry mixtures of materials are desirable in many different situations. Included among these situations are the inclusion of a solid diluent with such materials as a dry peroxy acid compound, a surfactant compound, a dry fertilizer material or an enzyme. These materials are only a few of the many which may be benefited by the present process's ability to: (1) form particles which are quickly dried; and (2) form small particles without the usual inherent dustiness associated with such formation.

The prior art contains many references which disclose compositions containing mixtures of hydratable materials with nonhydratable materials. Most such references, however, are not concerned with utilizing the hydratable material as a drying aid and, hence, do not address the favorable and unfavorable aspects of such use. One reference which does disclose the use of hydratable material as a drying aid is U.S. Pat. No. 3,770,816, Nov. 6, 1973, to Nielsen. This reference, while disclosing the use of a hydratable material to dry a nonhydratable material, diperisophthalic acid, does not disclose that the drying process has critical parameters which must be controlled.

It is, therefore, an object of this invention to provide a superior process for the drying of a mixture of hydratable and nonhydratable materials.

This and other objects of the present invention will become apparent from the following disclosure.

All percentages and ratios used herein are by weight unless otherwise specified.

SUMMARY

The present invention relates to a process for drying a mixture of hydratable materials and nonhydratable materials. The process involves the careful controlling of the drying temperatures to ensure hydration of the hydratable material(s) and the proper degree of subsequent water removal without the formation of adverse product properties.

DETAILED DESCRIPTION OF THE INVENTION

The process of the present invention comprises following steps:

A. Forming a water-wet mixture of a hydratable material and a nonhydratable material at a temperature which is higher than the temperature of hydration of the hydratable material;

B. Forming the mixture of (A) into smaller units of the desired size and shape;

C. Decreasing the temperature of the units of (B) to a temperature which is at or below the temperature of hydration of the hydratable material; and D. Drying the units of (C) at a temperature high enough to remove the amount of free water and water of hydration which is desired but not high enough to cause the units to soften and stick together.

The conditions for carrying out the process outlined above can be readily determined by the formulator for the combination of materials chosen for drying. It is to be appreciated that while a single hydratable material and a single nonhydratable material are shown in the above description, more than one of both types of agents may be employed in the present process.

Included among the extensive number of hydratable materials suitable for use in the process herein are sodium sulfate, calcium bromide, ferric bromide, ferric chloride, ferric nitrate, lithium bromide, sodium acetate, sodium arsenate, sodium perborate, sodium phosphite, sodium acid phosphite, stannous chloride, among many others. A preferred member of this group is sodium sulfate. If certain ions are undesirable for the use to which the dried mixture is to be put, compounds containing them are preferably avoided. For example, mixtures for use in a clothes washer should preferably not contain excessive amounts of iron compounds.

The nonhydratable materials as indicated hereinbefore can be any material which the formulator desires to combine with the hydratable material. The following are only a small example of the many agents which may find use in the present invention. Included are solid peroxyacid materials, surfactants, enzymes, fertilizers and other solid bleaching agents such as sodium hypochlorite.

A preferred nonhydratable material for use in the present process is a normally solid peroxyacid compound. A compound is "normally solid" if it is in dry or solid form at room temperature. Such peroxyacid compounds are the organic peroxyacids and water-soluble salts thereof which in aqueous solution yield a species containing a —O—O⁻ moiety. These materials have the general formula $$HO-O-\overset{\overset{\displaystyle O}{\|}}{C}-R-Y$$

wherein R is an alkylene group containing from 1 to about 20 carbon atoms or a phenylene group and Y is hydrogen, halogen, alkyl, aryl or any group which provides an anionic moiety in aqueous solution. Such Y groups can include, for example, $$-\overset{\overset{\displaystyle O}{\|}}{C}-OM,\ -\overset{\overset{\displaystyle O}{\|}}{C}-O-OM \text{ or } -\overset{\overset{\displaystyle O}{\|}}{\underset{\underset{\displaystyle O}{\|}}{S}}-OM$$

wherein M is H or a water-soluble, salt-forming cation.

The organic peroxyacids and salts thereof operable in the instant invention can contain either one or two peroxy groups and can be either aliphatic or aromatic. When the organic peroxyacid is aliphatic, the unsubstituted acid has the general formula

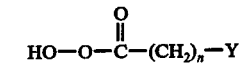

where Y, for example, can be $CH_3$, $CH_2Cl$,

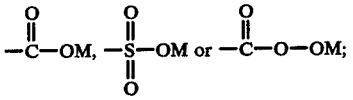

and $n$ can be an integer from 1 to 20. Perazelaic acid ($n = 7$) and perdodecanedioic acid ($n = 10$) where Y is

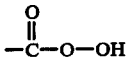

are the preferred compounds of this type. The alkylene linkage and/or Y (if alkyl) can contain halogen or other noninterfering substituents.

When the organic peroxyacid is aromatic, the unsubstituted acid has the general formula

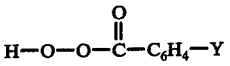

wherein Y is hydrogen, halogen, alkyl,

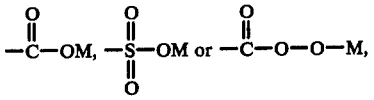

for example. The percarboxy and Y groupings can be in any relative position around the aromatic ring. The ring and/or Y group (if alkyl) can contain any noninterfering substituents such as halogen groups. Examples of suitable aromatic peroxyacids and salts thereof include monoperoxyphthalic acid, diperoxyterephthalic acid, 4-chlorodiperoxyphthalic acid, the monosodium salt of diperoxyterephthalic acid, m-chloroperoxybenzoic acid, p-nitroperoxybenzoic acid, and diperoxyisophthalic acid.

Of all the above-described organic peroxyacid compounds, the most preferred for use in the instant process are diperdodecanedioic acid and diperazelaic acid.

The amount of moisture present in the water-wet mixture of (A) is not critical. Depending upon the amount of hydratable material desirable (acceptable) in the final composition, various amounts of water may be bound to the hydratable material in the form of waters of hydration. Generally, however, the amount of water will be from about 10% to 30% based on the weight of all of the components present in the mixture.

The formation of the mixture of step (A) into smaller units as specified in step (B) can be done in any of many different ways. For example, the mixture may be formed into thin strips or noodles and then cut into smaller sizes to form particles; thin sheets may be formed and then broken into smaller pieces; or spherical shapes may be formed initially for use in that shape in the final composition. The latter shapes may be formed, for example, by pumping the mixture through a nozzle into a tower having the temperature desired in step (C). The formation of the desired shapes may also be done in two parts with part being done in step (B) and part in step (C).

The temperature to which the units of step (B) is reduced will depend on the hydratable materials(s) selected for use. Since it is desirable to at least case harden the particles, the temperature should be at or below the hydration temperature of the hydratable material. If a mixture of hydratable materials are used, the temperature can easily be determined by considering the total amount of hydratable materials present and their hydration temperatures. Examples of various hydratable materials and their approximate hydration temperatures are given below:

| | |
|---|---|
| Calcium bromide | 101° F |
| Ferric bromide | 81 |
| Ferric chloride | 99 |
| Ferric nitrate | 95 |
| Lithium bromide | 111 |
| Sodium acetate | 136 |
| Sodium arsenate | 82 |
| Sodium phosphate | 94 |
| Sodium perborate | 104 |
| Sodium acid phosphite | 108 |
| Stannous chloride | 100 |
| Zinc nitrate | 98 |
| Sodium sulfate | 90 |

If assurance of complete hydration and quicker solidification are desired, the temperature should preferably be reduced to a point below the above values. The achievement of the desired temperature can be made in a number of different ways including conventional heat exchangers, blowing air and temperature controlled spraying towers. The time of exposure to this low temperature can be varied by the processor and will be determined largely by the amount of hydratable materials present and the thickness of the individual particles. The temperature and time of exposure, therefore, can easily be determined by the processor depending on the type of equipment used and the physical properties of the individual particles.

The drying of the solid particles in step (D), as indicated hereinbefore, is for the purpose of removing the amount of free water and water of hydration desired by the formulator. In certain instances, as with the preferred peroxyacid compounds, it is desirable to remove virtually all of the water to improve the available oxygen stability of the peroxyacid. The air temperature must not be allowed, however, to reach a point where the shaped particles would become soft and stick together. Such problem occur at different air temperatures depending on the hydratable material used and the size and shape of the particles. With the preferred sodium sulfate the maximum air temperature is about 130° F (55° C) for particles in the shape of small noodles. At 130° F air temperature, the surface temperature of the solids, because of the cooling effect of evaporating water, is below the hydration temperature of sodium sulfate.

When the nonhydratable material is a peroxyacid and a low level of residual moisture is desired, it is necessary that steps be taken to ensure that the drying temperature does not allow the peroxyacid to exothermally decompose. Another way to help control the exotherm problem is to put an agent into the mixture which can release water at about the exotherm point, thereby controlling it. Agents of this type will be discussed subsequently. Of course, where the materials dried do not pose a safety problem of the exothermal decomposition type, it is not necessary to take such precautionary steps. The time of exposure to the drying temperature is variable depending on the temperature chosen, the hydratable material, the thickness of the individual particles and the drying technique, but will generally be from about several minutes to several hours at 100°–135° F. The actual unit used for this final drying can be any which does not involve the particles pressing together. Included are fluid bed dryers, moving belt dryers (forced air circulation), and any kind of forced air circulation dryers such as the Wyssmont Turbodryer supplied by Wyssmont Company of Ft. Lee, N.J.

It is readily seen that the dried mixtures prepared by the above-described process can be used in whatever end product form the formulator desires. Since one of the preferred materials for use herein is a peroxyacid bleaching agent, agents which are desirable for use with the bleach are described below.

Total Composition

In formulating a total composition containing the dried units of the process of the present invention wherein a peroxyacid is the nonhydratable material of choice, certain additional components are desirable. The compositions containing the peracid compound, which is preferably in granular particulate form, may contain agents which aid in making the product completely safe, as well as stable. These agents can be designated as carriers.

It is well documented in the peroxyacid literature that peroxyacids are susceptible to a number of different stability problems, as well as being likely to cause some problems. Looking at the latter first, peroxyacids decompose exothermally and when the material is in dry granular form the heat generated must be controlled to make the product safe. The best exotherm control agents are those which are capable of liberating moisture at a temperature slightly below the decomposition temperature of the peroxyacid employed. U.S. Pat. No. 3,770,816, Nov. 6, 1973, to Nielsen, incorporated herein by reference, discloses a wide variety of hydrated materials which can serve as suitable exotherm control agents. Included among such materials are magnesium sulfate $.7H_2O$, magnesium formate dihydrate, calcium sulfate ($CaSO_4.2H_2O$), calcium lactate hydrate, calcium sodium sulfate ($CaSO_4.2Na_2SO_4.2H_2O$), and hydrated forms of such things as sodium aluminum sulfate, potassium aluminum sulfate, ammonium aluminum sulfate and aluminum sulfate. Preferrred hydrates are the alkali metal aluminum sulfates, particularly preferred is potassium aluminum sulfate. Other preferred exotherm control agents are those materials which lose water as the result of chemical decomposition such as boric acid, malic acid and maleic acid. The exotherm control agent is preferably used in an amount of from about 100 to about 200% based on the weight of the peroxyacid compound.

The other problems faced when peroxyacid compounds are used fall into the area of maintaining good bleach effectiveness. It has been recognized that metal ions are capable of serving as catalyzing agents in the degradation of the peroxyacid compounds. To overcome this problem chelating agents can be used in an amount ranging from 0.005 to about 1.00% based on the weight of the composition to tie up heavy metal ions. U.S. Pat. No. 3,442,937, May 6, 1969, to Sennewald et al., discloses a chelating system comprising quinoline or a salt thereof, an alkali metal polyphosphate and, optionally, a synergistic amount of urea. U.S. Pat. No. 2,838,459, June 10, 1958, to Sprout, Jr., discloses a variety of polyphosphates as stabilizing agents for peroxide baths. These materials are useful herein as stabilizing aids. U.S. Pat. No. 3,192,255, June 29, 1965, to Cann, discloses the use of quinaldic acid to stabilize percarboxylic acids. This material, as well as picolinic acid and dipicolinic acid, would also be useful in the compositions of the present invention. A preferred chelating system for the present invention is a mixture of 8-hydroxyquinoline and an acid polyphosphate preferably acid sodium pyrophosphate. The acid polyphosphate can be a mixture of phosphoric acid and sodium pyrophosphate wherein the ratio of the former to the latter is from about 0.5:1 to about 2:1 and the ratio of the mixture to 8-hydroxyquinoline is from about 0.2:1 to about 5:1.

Additional agents which may be used to aid in giving good bleaching performance include such things as pH adjustment agents, bleach activators and minors such as coloring agents, dyes and perfumes. Typical pH adjustment agents are used to alter or maintain aqueous solutions of the instant compositions within the 5 to 10 pH range in which peroxyacid bleaching agents are generally most useful. Depending upon the nature of other optional composition ingredients, pH adjustment agents can be either of the acid or base type. Examples of acidic pH adjustment agents designed to compensate for the presence of other highly alkaline materials include normally solid organic and inorganic acids, acid mixtures and acid salts. Examples of such acidic pH adjustment agents include citric acid, glycolic acid, tartaric acid, gluconic acid, glutamic acid, sulfamic acid, sodium bisulfate, potassium bisulfate, ammonium bisulfate and mixtures of citric acid and lauric acid. Citric acid is preferred by virtue of its low toxicity and hardness sequestering capability.

Optional alkaline pH adjustment agents include the conventional alkaline buffering agents. Examples of such buffering agents include such salts as carbonates, bicarbonates, silicates, pyrophosphates and mixtures thereof. Sodium bicarbonate and tetrasodium pyrophosphate are highly preferred.

Optional ingredients, if utilized in combination with the active peroxyacid/hydratable material system of the instant invention to form a complete bleaching product, comprise from about 50 to about 95% by weight of the total composition. Conversely, the amount of bleaching system is from about 5 to about 50% of the composition. Optional ingredients such as the exotherm control agent and the metal chelating agent are preferably mixed with the peroxyacid and the hydratable material in step (A), thereby becoming a part of the dry units formed in the process. Others such as the pH adjustment agents are added as separate particles. Such other ingredients may be coated with, for example, an inert fatty material if the ingredients are likely to cause degradaton of the peroxyacid.

The bleaching compositions as described above can also be added to and made a part of conventional fabric laundering detergent compositions. Accordingly, optional materials for the instant bleaching compositions can include such standard detergent adjuvants as surfactants and builders. Optional surfactants are selected from the group consisting of organic anionic, nonionic, ampholytic and zwitterionic surfactants and mixtures thereof. Optional builder materials include any of the conventional organic builder salts including carbonates, silicates, acetates, polycarboxylates, and phosphates. If the instant bleaching compositions are employed as part of a conventional fabric laundering detergent composition, the instant bleaching particles generally comprise from about 1 to about 40% by weight of such conventional detergent compositions. Conversely, the instant bleaching compositions can optionally contain from about 60 to about 99% by weight of conventional surfactant and builder materials. Further examples of suitable surfactants and builders are given below.

Water-soluble salts of the higher fatty acids, i.e., "soaps," are useful as the anionic surfactant herein. This class of surfactants includes ordinary alkali metal soaps such as the sodium, potassium, ammonium and alkanolammonium salts of higher fatty acids containing from about 8 to about 24 carbon atoms and preferably from about 10 to about 20 carbon atoms. Soaps can be made by direct saponification of fats and oils or by the neutralization of free fatty acids. Particularly useful are the sodium and potassium salts of the mixtures of fatty acids derived from coconut oil and tallow, i.e., sodium or potassium tallow and coconut soaps.

Another class of anionic surfactants includes water-soluble salts, particularly the alkali metal, ammonium and alkanolammonium salts, of organic sulfuric reaction products having in their molecular structure an alkyl group containing from about 8 to about 22 carbon atoms and a sulfonic acid or sulfuric acid ester group. (Included in the term "alkyl" is the alkyl portion of acyl groups.) Examples of this group of synthetic surfactants which can be used in the present detergent compositions are the sodium and potassium alkyl sulfates, especially those obtained by sulfating the higher alcohols ($C_8$–$C_{18}$ carbon atoms) produced by reducing the glycerides of tallow or coconut oil; and sodium and potassium alkyl benzene sulfonates, in which the alkyl group contains from about 9 to about 15 carbon atoms in straight chain or branched chain configuration, e.g., those of the type described in U.S. Pat. Nos. 2,220,099, and 2,477,383, incorporated herein by reference.

Other anionic surfactant compounds useful herein include the sodium alkyl glyceryl ether sulfonates, especially those ethers or higher alcohols derived from tallow and coconut oil; sodium coconut oil fatty acid monoglyceride sulfonates and sulfates; and sodium or potassium salts of alkyl phenol ethylene oxide ether sulfate contaning about 1 to about 10 units of ethylene oxide per molecule and wherein the alkyl groups contain about 8 to about 12 carbon atoms.

Other useful anionic surfactants herein include the water-soluble salts of esters of $\alpha$-sulfonated fatty acids containing from about 6 to 20 carbon atoms in the ester group; water-soluble salts of 2-acyloxy-alkane-1-sulfonic acids containing from about 2 to 9 carbon atoms in the acyl group and from about 9 to about 23 carbon atoms in the alkane moiety; alkyl ether sulfates containing from about 10 to 20 carbon atoms in the alkyl group and from about 1 to 30 moles of ethylene oxide; water-soluble salts of olefin sulfonates containing from about 12 to 24 carbon atoms; and $\beta$-alkyloxy alkane sulfonates containing from about 1 to 3 carbon atoms in the alkyl group and from about 8 to 20 carbon atoms in the alkane moiety.

Preferred water-soluble anionic organic surfactants herein include linear alkyl benzene sulfonates containing from about 11 to 14 carbon atoms in the alkyl group; the tallow range alkyl sulfates; the coconut range alkyl glyceryl sulfonates; and alkyl ether sulfates wherein the alkyl moiety contains from about 14 to 18 carbon atoms and wherein the average degree of ethoxylation varies between 1 to 6.

Specific preferred anionic surfactants for use herein include: sodium linear $C_{10}$–$C_{12}$ alkyl benzene sulfonate; triethanolamine $C_{10}$–$C_{12}$ alkyl benzene sulfonate; sodium tallow alkyl sulfate; sodium coconut alkyl glyceryl ether sulfonate; and the sodium salt of a sulfated condensation product of tallow alcohol with from about 3 to about 10 moles of ethylene oxide.

It is to be recognized that any of the foregoing anionic surfactants can be used separately herein or as mixtures.

Nonionic surfactants include the water-soluble ethoxylates of $C_{10}$–$C_{20}$ aliphatic alcohols and $C_6$–$C_{12}$ alkyl phenols. Many nonionic surfactants are especially suitable for use as suds controlling agents in combination with anionic surfactants of the type disclosed herein.

Semi-polar surfactants useful herein include water-soluble amine oxides containing one alkyl moiety of from about 10 to 28 carbon atoms and 2 moieties selected from the group consisting of alkyl groups and hydroxyalkyl groups containing from 1 to about 3 carbon atoms; water-soluble phosphine oxides containing one alkyl moiety of about 10 to 28 carbon atoms and 2 moieties selected from the group consisting of alkyl groups and hydroxyalkyl groups containing from about 1 to 3 carbon atoms; and water-soluble sulfoxides containing one alkyl moiety of from about 10 to 28 carbon atoms and a moiety selected from the group consisting of alkyl and hydroxyalkyl moieties of from 1 to 3 carbon atoms.

Ampholytic surfactants include derivatives of aliphatic or aliphatic derivatives of heterocyclic secondary and tertiary amines in which the aliphatic moiety can be straight chain or branched and wherein one of the aliphatic substituents contains from about 8 to 18 carbon atoms and at least one aliphatic substituent contains an anionic water-solubiizing group.

Zwitterionic surfactants include derivatives of aliphatic quaternary ammonium, phosphonium and sulfonium compounds in which the aliphatic moieties can be straight or branched chain, and wherein one of the aliphatic substituents contains from about 8 to 18 carbon atoms and one contains an anionic water-solubilizing group.

The instant granular compositions can also comprise those detergency builders commonly taught for use in laundry compositions. Useful builders herein include any of the conventional inorganic and organic water-soluble builder salts, as well as various water-insoluble and so-called "seeded" builders.

Inorganic detergency builders useful herein include, for example, water-soluble salts of phosphates, pyrophosphates, orthophosphates, polyphosphates, phosphonates, carbonates, bicarbonates, borates and silicates. Specific examples of inorganic phosphate builders include sodium and potassium tripolyphosphates, phosphates, and hexametaphosphates. The polyphosphonates specifically include, for example, the sodium and potassium salts of ethylene diphosphonic acid, the sodium and potassium salts of ethane 1-hydroxy-1,1-diphosphonic acid, and the sodium and potassium salts of ethane-1,1,2-triphosphonic acid. Examples of these and other phosphorus builder compounds are disclosed in U.S. Pat. Nos. 3,159,581; 3,213,030; 3,422,021; 3,422,137; 3,400,176 and 3,400,148, incorporated herein by reference. Sodium tripolyphosphate is an especially preferred, water-soluble inorganic builder herein.

Non-phosphorus containing sequestrants can also be selected for use herein as detergency builders. Specific examples of non-phosphorus, inorganic builder ingredients include water-soluble inorganic carbonate, bicarbonate, borate and silicate salts. The alkali metal, e.g., sodium and potassium, carbonates, bicarbonates, borates (Borax) and silicates are particularly useful herein.

Water-soluble, organic builders are also useful herein. For example, the alkali metal, ammonium and substituted ammonium polyacetates, carboxylates, polycarboxylates, succinates, and polyhydroxysulfonates are useful builders in the present compositions and processes. Specific examples of the polyacetate and polycarboxylate builder salts include sodium, potassium, lithium, ammonium and substituted ammonium salts of ethylene diamine tetraacetic acid, nitrilotriacetic acid, oxydisuccinic acid, mellitic acid, benzene polycarboxylic acids, and citric acid.

Highly preferred non-phosphorous builder materials (both organic and inorganic) herein include sodium carbonate, sodium bicarbonate, sodium silicate, sodium citrate, sodium oxydisuccinate, sodium mellitate, sodium nitrilotriacetate, and sodium ethylenediaminetetraacetate, and mixtures thereof.

Another type of detergency builder material useful in the present compositions and processes comprises a water-soluble material capable of forming a water-insoluble reaction product with water hardness cations in combination with a crystallization seed which is capable of providing growth sites for said reaction product.

Specific examples of materials capable of forming the water-insoluble reaction product include the water-soluble salts of carbonates, bicarbonates, sequicarbonates, silicates, aluminates and oxalates. The alkali metal, especially sodium, salts of the foregoing materials are preferred for convenience and economy.

Another type of builder useful herein includes various substantially water-insoluble materials which are capable of reducing the hardness content of laundering liquors, e.g., by ion-exchange processes. Examples of such builder materials include the phosphorylated cloths disclosed in U.S. Pat. No. 3,424,545, Bauman, issued Jan. 28, 1969, incorporated herein by reference.

The complex aluminosilicates, i.e., zeolite-type materials, are useful presoaking/washing adjuvants herein in that these materials soften water, i.e., remove $Ca^{++}$ hardness. Both the naturally occurring and synthetic "zeolites", especially zeolite A and hydrated zeolite A materials, are useful for this builder/softener purpose. A description of zeolite materials and a method of preparation appears in Milton, U.S. Pat. No. 2,882,243, issued Apr. 14, 1959, incorporated herein by reference.

Composition Preparation

Bleaching granules prepared using the process of the present invention can be admixed with other granules of optional bleaching or detergent composition materials. Actual particle size of either the bleach containing granules or optional granules of additional material is not critical. If, however, compositions are to be realized having commercially acceptable flow properties, certain granule size limitations are highly preferred. In general, all granules of the instant compositions preferably range in size from about 100 microns to 3000 microns, more preferably from about 100 microns to 1300 microns.

Additionally, flowability is enhanced if granules of the present invention are of approximately the same size. Therefore, preferably the ratio of the average granule sizes of the bleach-containing granules and optional granules of other materials varies between 0.5:1 and 2.0:1.

Bleaching compositions of the present invention are utilized by dissolving them in water in an amount sufficient to provide from about 1.0 ppm to 100 ppm available oxygen in solution. Generally, this amounts to about 0.01 to 0.2% by weight of composition in solution. Fabrics to be bleached are then contacted with such aqueous bleaching solutions.

The bleaching compositions of the instant invention are illustrated by the following examples but not limited thereto:

EXAMPLE I

The following composition is prepared and processed according to the present invention:

| | |
|---|---|
| Diperoxydodecanedioic acid/water mixture (40% acid, 60% water) | 2.5 parts |
| Boric acid | 1.5 parts |
| Anhydrous sodium sulfate | 6.0 parts |
| Surfactant paste (50% water, 27.6% $C_{13}$ linear alkyl benzene sulfonate 23.4% sodium sulfate) | 0.7 parts |

The above blend having a temperature of about 90° F is extruded into 1/16 inch diameter noodles, chilled for about 8 seconds on a belt over which cold air (40°-50° F) is blown, broken into ¼-⅜ inch long segments and dried for about 3 hours at 120°-125° F by means of a turbodryer. The particles following the cooling at 40°-50° F for about 8 seconds are solidified. Further, the particles after the final drying step do not lump together.

EXAMPLE II

A composition identical to that of Example I but containing no sodium sulfate is prepared. The process of Example I cannot be followed since the particles exposed to the 40°-50° F temperature do not solidify.

EXAMPLE III

A compositon identical to that of Example I but containing 1 part of sodium sulfate instead of 6 is prepared. The process is identical to that of Example I except that the time of exposure to the 40°-50° F temperature is increased to 115 seconds. Such increase in exposure time is required to achieve the desired solidification.

EXAMPLE IV

A composition identical to that of Example I but contaning 3 parts of sodium sulfate instead of 6 is prepared. The process is identical to that of Example I except that the time of exposure to the 40°-50° F temperature is increased to 23 seconds. Such increase in exposure time is required to achieve the desired solidificaton.

Processes and results similar to those described in Examples I-IV can be obtained if the peroxyacid is replaced by another normally solid peroxyacid, a surfactant, an enzyme or a fertilizer compound and sodium slfate is replaced by calcium bromide, ferric bromide, ferric chloride, ferric nitrate, lithium bromide, sodium acetate, sodium arsenate, sodium perborate, sodium phosphite, sodium acid phosphite, or stannous chloride.

What is claimed is:

1. A process for drying a mixture of materials comprising:

A. Forming a water-wet mixture of a hydratable material and a nonhydratable material at a temperature which is higher than the temperature of hydration of the hydratable material;

B. Forming the mixture of (A) into smaller units of the desired size and shape;

C. Decreasing the temperature of the units of (B) to a temperature which is at or below the hydration temperature of the hydratable material; and D. Drying the units of (C) at a temperature high enough to remove the amount of free water and water of hydration which is desired but not high enough to cause the units to soften and stick together.

2. A process according to claim 1 wherein the hydratable material is selected from the group consisting of sodium sulfate, calcium bromide, ferric bromide, ferric chloride. ferric nitrate, lithium bromide, sodium acetate, sodium arsenate, sodium perborate, sodium phosphite, sodium acid phosphite and stannous chloride.

3. A process according to claim 2 wherein the nonhydratable material is a normally solid peroxyacid compound.

4. A process according to claim 3 wherein the hydratable material is sodium sulfate.

5. A process according to claim 4 wherein the peroxyacid compound is selected from the group consisting of diperdodecanedioic acid and diperazelaic acid.

6. A process according to claim 5 wherein an exotherm control agent is included in the mixture of (A).

7. A process according to claim 6 wherein the temperature of (C) is equal to or less than 90° F and the temperature of (D) is less than 130° F.

* * * * *